US005213220A

United States Patent [19]

McBride

[11] Patent Number: 5,213,220

[45] Date of Patent: May 25, 1993

[54] DISPLAY RACK AND BLANK FOR FORMING SAME

[75] Inventor: Peter McBride, Orange, Calif.

[73] Assignee: O'Brien Industries, Inc., Cypress, Calif.

[21] Appl. No.: 892,586

[22] Filed: Jun. 3, 1992

[51] Int. Cl.[5] ..... A47F 5/00

[52] U.S. Cl. ..... 211/132; 211/73; 211/149; 248/174

[58] Field of Search ..... 211/132, 149, 72, 73, 211/59.1, 57.1; 248/174

[56] References Cited

U.S. PATENT DOCUMENTS

| | | | |
|---|---|---|---|
| 1,315,524 | 9/1919 | Mittleburg | 211/149 X |
| 2,918,178 | 12/1959 | Leone | 248/174 X |
| 3,576,259 | 6/1969 | Leath | 211/149 |
| 4,576,291 | 3/1986 | Stein | 211/59.1 X |
| 4,646,922 | 3/1987 | Smith | 248/174 X |
| 4,671,417 | 6/1987 | O'Brien | 211/59.1 |
| 4,724,967 | 2/1988 | Valiulis | 211/59.1 |
| 4,733,782 | 3/1988 | Spezial et al. | 211/57.1 |
| 4,911,311 | 3/1990 | Nagai | 248/174 X |
| 4,949,851 | 8/1990 | Shaffer | 211/149 |

*Primary Examiner*—Robert W. Gibson, Jr.
*Attorney, Agent, or Firm*—Poms, Smith, Lande & Rose

[57] ABSTRACT

A display rack having a plurality of vertically spaced compartments. Slots are provided in the rear wall of the rack in each compartment for receiving a display hook therein. Display items therein can be mounted on the hooks such that a plurality of such items are disposed in each compartment. The rack may be quickly and easily assembled from a planar sheet of material.

8 Claims, 4 Drawing Sheets 16
34
33
14
22
35
A
33
20
33
16
18
17
21
2
2
15
22
33
33
23
28
10
33
33
24
29
14
25
33
26
5
30
5
31
32
27
12

15
26
141
124
137
17
73

DISPLAY RACK AND BLANK FOR FORMING SAME

BACKGROUND OF THE INVENTION

1. Field of the Invention

The invention relates to display racks; and, more particularly, to a display rack having an plurality of vertically spaced compartments.

2. Description of the Prior Art

Many types of display racks are well known in the art. Some of these racks can be assembled from planar sheets of material. However, such racks may be difficult for a novice to assemble and may take time to do so. Also, such racks may not have sufficient spaced separate compartments for displaying a plurality of display items in each compartment on hooks or the like where the items can be easily slid off of the hooks.

There thus exists a need for a display rack that can be quickly and easily assembled from a single sheet of planar material and having a plurality of vertically spaced compartments with hook receiving slots therein.

SUMMARY OF THE INVENTION

It is an object of this invention to provide an improved display rack.

It is a further object of this invention to provide a display rack having a plurality of vertically spaced separate compartments with hook means in each compartment.

It is still further an object of this invention to carry out the foregoing object with a pair of vertical horizontally spaced rows of such compartments.

It is another object of this invention to carry out the foregoing objects wherein the rack may be quickly and easily formed from a planar sheet of material.

These and other objects are preferably accomplished by providing a display rack having a plurality of vertically spaced compartments. Slots are provided in the rear wall of the rack in each compartment for receiving a display hook thereon. Display items can be mounted on the hooks such that a plurality of such items are disposed in each compartment. The rack may be quickly and easily assembled from a planar sheet of material.

DESCRIPTION OF THE PREFERRED EMBODIMENT

Figures 1, 5, 8:
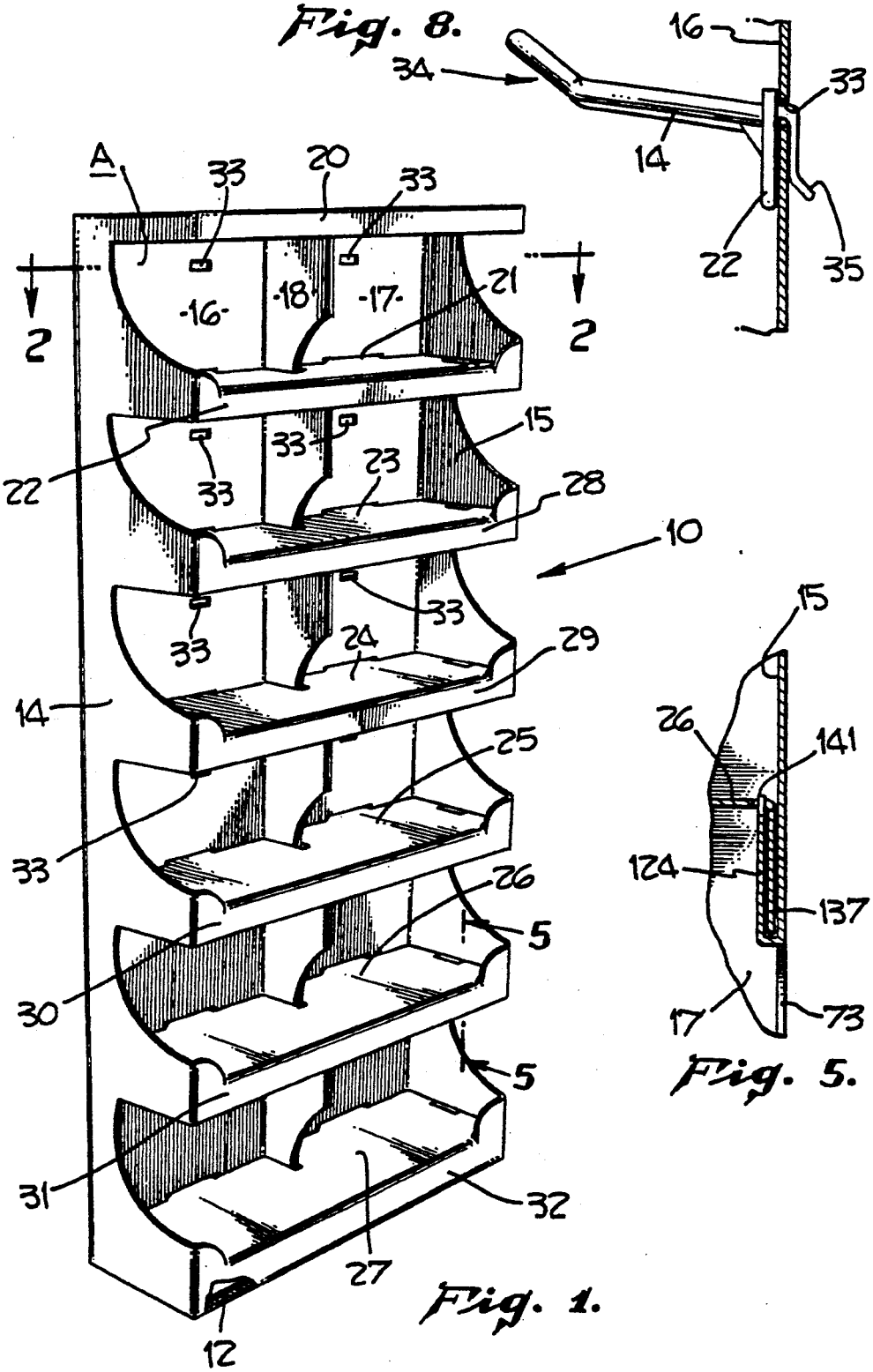
FIG. 1 is a perspective view, partly in section, of a display rack in accordance with the teachings of the invention.
FIG. 5 is a view taken along lines 5—5 of FIG. 1.
FIG. 8 is a cross-section of a portion of the rear wall of the display rack of FIGS. 1 through 6 where the slot is located, illustration insertion of a display hook therein.

Referring now to FIG. 1 of the drawing, a display rack 10 is shown having a planar top wall 11 (FIG. 3), a planar bottom wall 12 (FIG. 1) planar rear wall 13 (FIGS. 2 and 3) and interconnecting spaced side walls 14, 15.

Figure 2:
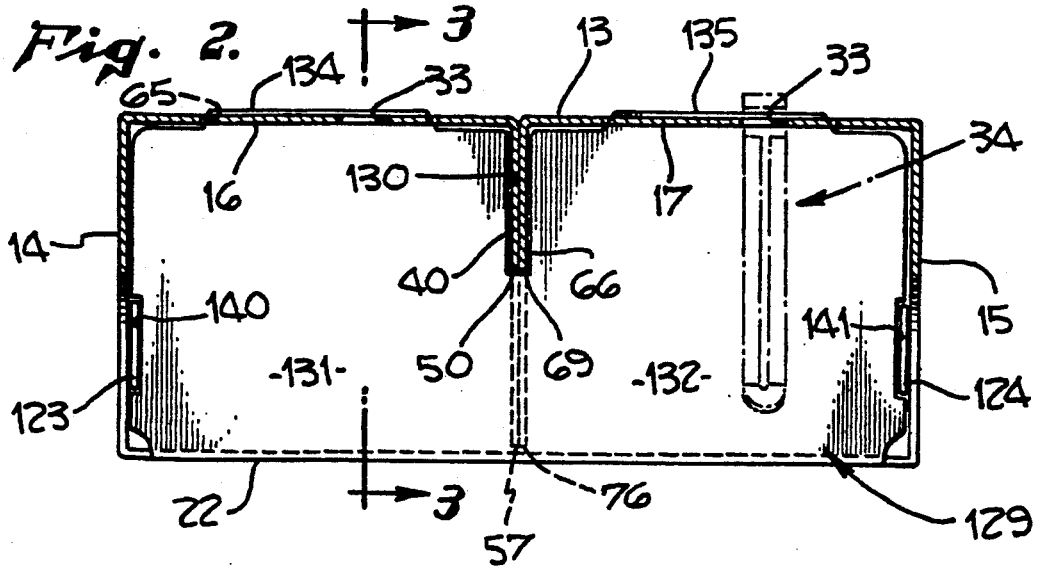
FIG. 2 is a view taken along lines 2—2 of FIG. 1.
Figure 3:
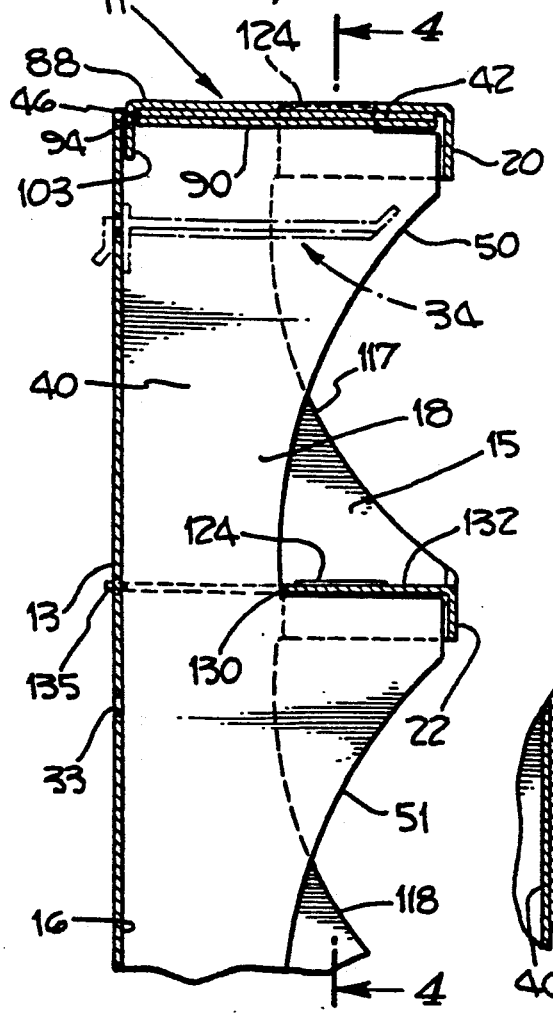
FIG. 3 is a view taken along lines 3—3 of FIG. 2.

As seen in FIG. 2, rear wall 13 is comprised of two rear wall sections 16, 17 having inwardly turning flanges 40, 66 integral with sections 16, 17, respectively. Top wall 11 has a front wall portion 20 (FIG. 1) extending along the front spaced from a ledge 21. Ledge 21 also has a front wall portion 22 extending between side walls 14, 15.

Similar spaced ledges 23 through 27 are provided along rack 10 each having a front wall portion (portions 28 through 32, respectively) similar to front wall portion 22. Of course, any suitable number of ledges 21 and 23 through 27 may be provided.

The relationship of the rear wall sections 16, 17, flanges 40, 66, side walls 14, 15, and top wall 20 (along with ledges 21 and 23 through 27) form a plurality of vertically and horizontally spaced compartments (e.g., compartment A in FIG. 1 being formed by top wall 11, ledge 21, side wall 14 and flange 40). Two horizontally spaced rows of such vertically spaced compartments are provided. Of course, any number of such rows can be provided.

Figure 4:
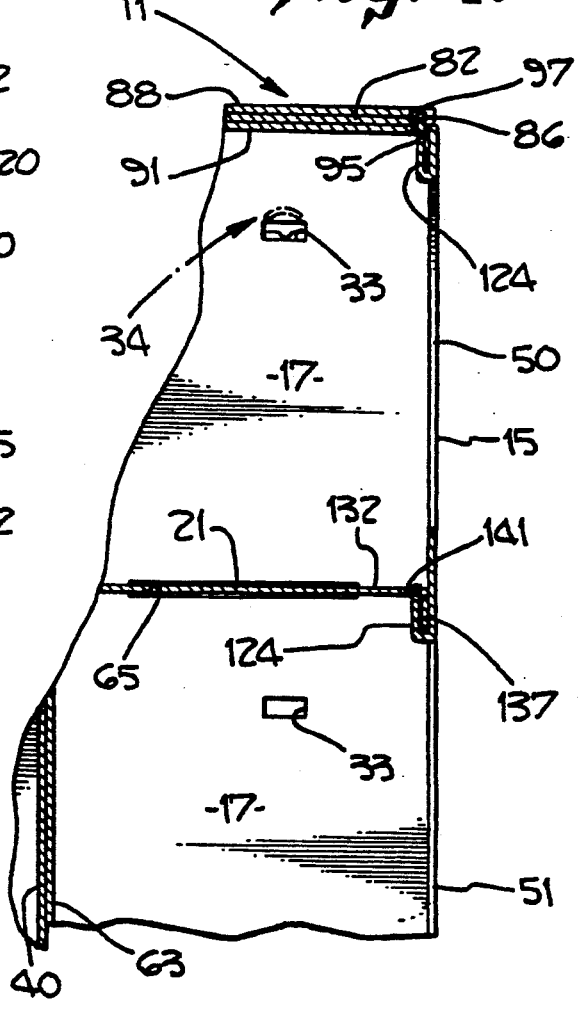
FIG. 4 is a view taken along lines 4—4 of FIG. 3.

Each compartment A, at a centrally located position in rear wall 13, has a horizontal slot 33 therein. These slots 33 are adapted to receive a display hook therein. For example, in my U.S. Pat. No. 4,671,417, the teachings of which are incorporated herein by reference, a support fixture or display hook is disclosed. In FIG. 8, hook 34 in FIG. 8 is identical to fixture 12 of U.S. Pat. No. 4,671,417, and thus also has an integral and support member 114 which has a finger 35 insertible into a horizontal slot, such as slot 33 in FIG. 8. See also the dotted lines in FIGS. 2, 3 and 4.

Of course, other display hooks may be used but the support fixture in my patent is particularly suited to the rack 10 of this invention. Display items, having apertures for receiving display hook 34 therethrough, may be quickly and easily mounted on such hooks 34. Thus, a plurality of display items, the same or different, may be mounted in each compartment A.

The display rack 10 of FIG. 1 can be formed of any suitable materials, such as plastic, cardboard, etc., and may be a free-standing unit of one piece or a plurality of interconnected parts. It may also be a knockdown display rack that is assembled as seen in FIG. 1.

Figure 6:
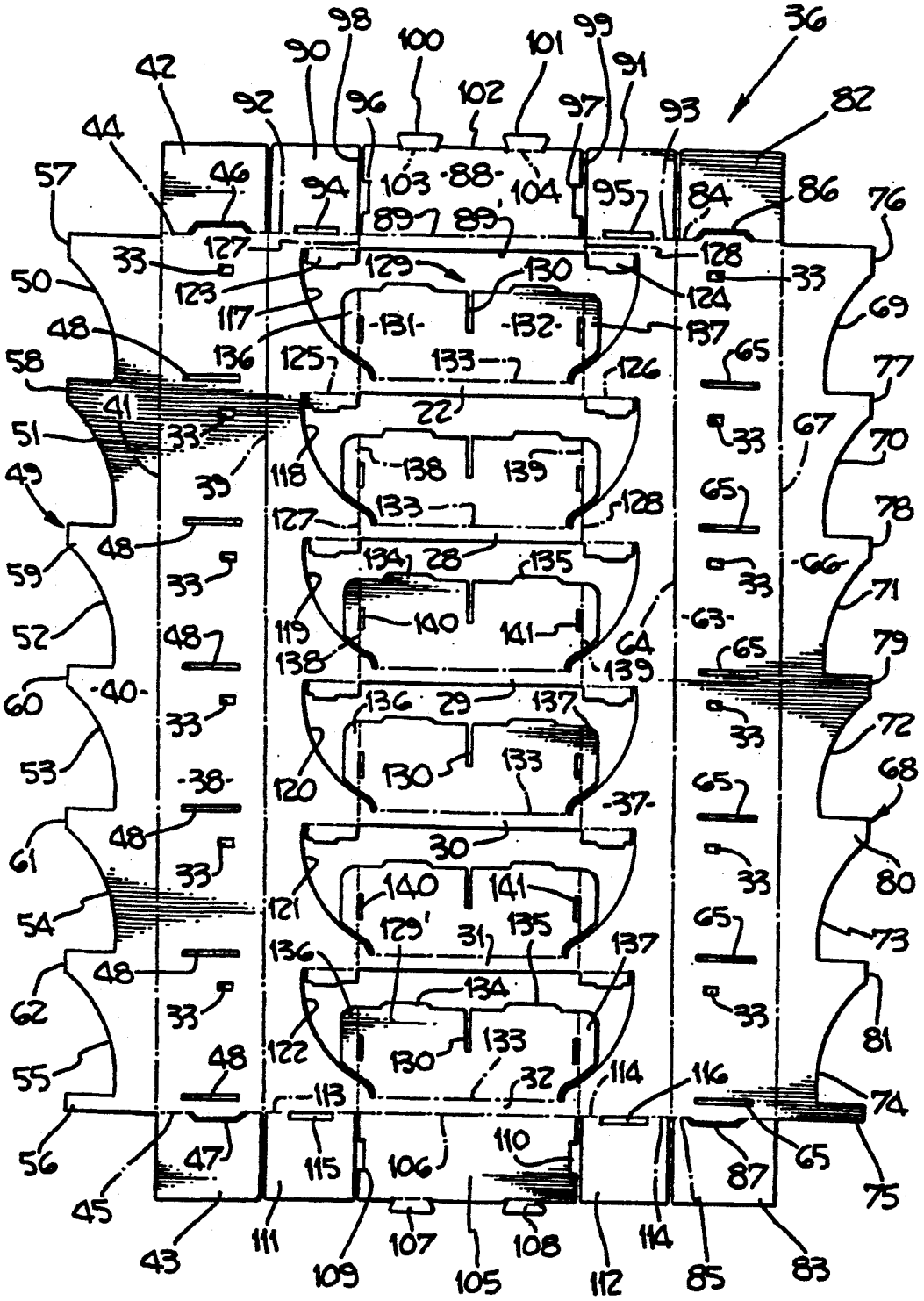
FIG. 6 is a plan view of a single sheet of die cut planar material from which the rack of FIGS. 1 through 5 is formed.

Preferably, however, the rack of FIG. 1 is formed from a single blank of a suitable foldable planar material, such as cardboard. Thus, as seen in FIG. 6, a blank 36 is provided having a planar generally rectangular main body portion 37. Main body portion 37 has a first outer side row 38 separated from main body portion 37 by a fold line 39. A flange or flap 40 is integral with row 38 connected thereto by fold line 41. A pair of flaps 42, 43 are provided at each end of row 38 connected thereto by fold lines 44, 45, respectively. A trapezoidally-shaped cut-out or slot 46, 47 is provided along fold lines 44, 45, respectively, at the middle thereof. Slots 33 are provided at spaced locations along row 38 and elongated spaced slots 48 are also provided at spaced locations along row 38.

Flap 40 has an erose side edge 49 formed by spaced arcuate sections 50 through 55. An elongated tab 56 is formed at the terminal end of arcuate sections 50 through 55. First arcuate section 50 terminates at the upper end in a tab 57. Like tabs 58 through 62 separate each arcuate sections 50 through 55, respectively.

Row 63 on the other side of main body portion 37, and coupled thereto by fold line 64, also has aforementioned spaced slots 33 and spaced slots 65 identical to aforementioned slots 48. Flange or flap 66 is connected to row 63 by fold line 67 and has an outer erose edge 68 formed by spaced arcuate sections 69 through 74. Tab 75 is identical to tab 56 and tabs 76 to 81 are identical to tabs 57 through 62. End flaps 82, 83 are connected to row 63 by fold lines 84, 85, respectively, with cut out sections 86, 87 similar to sections 46, 47.

Main body portion 37 has, at the top, a first central main flap 88 connected thereto by fold line 89. Flaps 90, 91, on each side of flap 88, are connected to main body portion 37 by fold lines 92, 93, respectively.

Slots 94, 95 are provided along fold lines 92, 93, respectively, and cut-out sections 96, 97 are formed along edges 98, 99, respectively, of flap 88. A pair of spaced tabs 100, 101 are provided along the upper edge 102 of flap 88 connected thereto along fold lines 103, 104, respectively.

A central flap 105, similar to flap 88, is provided at the bottom of main body portion 37 connected thereto along fold line 106. Flap 105 has spaced tabs 107, 108, connected along fold lines 109, 110, respectively, similar to tabs 100, 101, Cut-out sections 109', 110' are provided on flap 105 similar to sections 96, 97. Side flaps 111, 112, similar to flaps 90, 91, are provided on each side of central flap 105 connected to main body portion 37 along fold lines 113, 114, respectively. Cut-out slots 115, 116, similar to slots 94, 95, respectively, are provided along fold lines 113, 114, respectively.

Main body portion 37 is comprised of a plurality of cut-out sections, such as sections 117 through 122. Each section 117 through 122 has an upper elongated edge 89' extending parallel to fold line 89 and a pair of spaced tabs 123, 124 connected to main body portion 37 by fold lines 125, 126, respectively. A fold line 127 is provided at the intersection at the right side (as seen in FIG. 6) of each tab 123 with main body portion 37 extending normal to fold line 125. In like manner, a fold line 128 is provided at the intersection of the left side of each tab 124 with main body portion 37 extending normal to fold line 126. Of course, fold lines 127, 128 may be offset slightly from the intersection with the respective side of tabs 123, 124, due to manufacturing tolerances.

A generally rectangular panel 129 is provided in each cut-out section 117 through 122 divided by a slot 130 into two separate sections 131, 132. As will be discussed, these sections 129 form the ledges 21 and 23 through 27 of the display rack 10 of FIG. 1.

Each section 129 is connected via fold line 133 to strips 22 and 28 through 32 connected to main body portion 37. Strips 22 and 28 through 32 are in fact the aforementioned front wall portions of the display rack 10 of FIG. 1 with fold lines 127, 128 at opposite ends thereof.

Each section 131, 132 has a tab 134, 135, respectively and side flaps 136, 137, respectively. Side flaps 136, 137 are connected to their respective section 131, 132 along fold lines 138, 139, respectively. Slots 140, 141 are provided at the midpoint along each fold line 138, 139, respectively.

Figure 7:
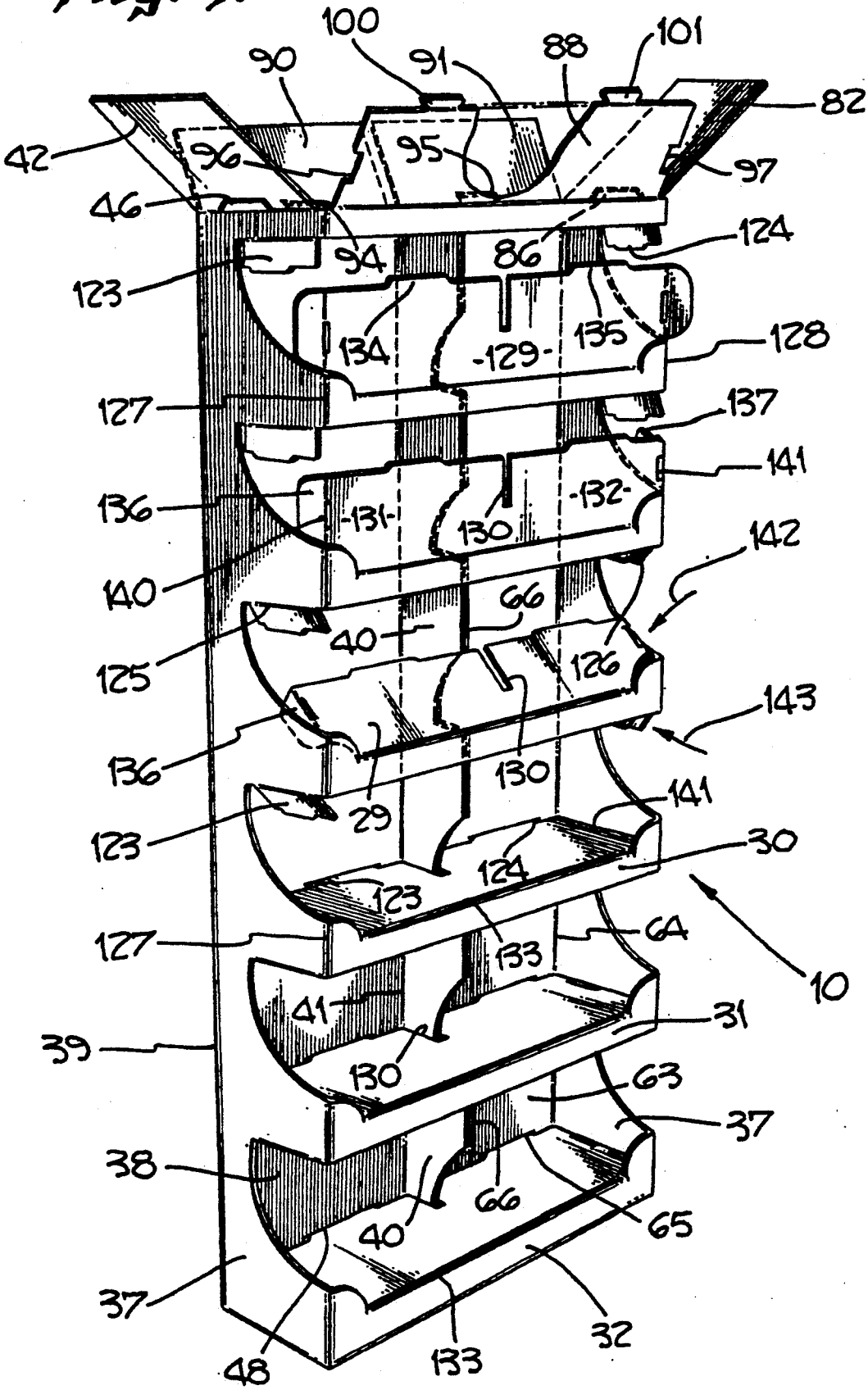
FIG. 7 is a perspective view illustrating the folding of the sheet of FIG. 6 to form the rack of FIG. 1.

Referring now to FIGS. 6 and 7, the blank 36 of FIG. 6 is folded to quickly and easily assemble it into the rack of FIG. 1.

Blank 36 is first folded along fold lines 127, 128. It is then folded along fold lines 39, 41, on one side. This results in flange or flap 40 abutting against flange or flap 66 extending internally of the rack 10 and perpendicular to the rear wall 13 (see FIG. 2). Flaps 90, 91 are folded inwardly and flaps 42, 82 are folded inwardly and on top of flaps 90, 91, respectively. Flap 88 is now folded over and on top of flaps 82, 42 (see FIGS. 3 and 7) with tabs 100, 101 locking into slots 46, 94 and 86, 95, respectively. Tabs 123, 124 are folded internally and lock into slots 96, 97, respectively (see FIGS. 3 and 4).

Each section 129 is now folded inwardly (see arrow 142 in FIG. 7), tabs 136, 137, being folded, until slot 130 receives therebetween the abutting flaps 40, 66 (FIG. 2) and tabs 134, 135 enter slots 48, 65, respectively. This forms sections 22 and 28 through 32 and tabs 123, 124 can now be folded inwardly in the direction of arrow 143 (FIG. 7) and locked into slots 140, 141, respectively (see FIG. 5).

Bottom flaps 111, 112 are now folded inwardly with flaps 43, 83 folded on top of the same, respectively. Bottom flap 105 can now be folded over a top of flaps 43, 83 with tabs 107, 108 locking into slots 47, 115 and 87, 116, respectively. The bottommost section 129' (FIG. 6), identical to section 129 heretofore discussed, is folded over and down between the flaps side walls 14, 15 with slot 130 in section 129' receiving therebetween abutting flaps 40, 66, tabs 136, 137 of section 129' being folded downwardly and abutting against side walls 14, 15, respectively. Tabs 134, 135 of section 129' being receivable in bottommost slots 48, 45 (FIG. 6). Tabs 123, 124 at bottom are folded internally and locked into slots 109', 110', respectively.

The final assembled display rack 10 is as shown in FIG. 1.

It can be seen that there is described a display rack that can be quickly and easily formed from a blank that has been pre-stamped or die-cut or the like. Any suitable materials can be used but cardboard is preformed for its ability to be folded and retain its shape. Hooks, similar to those in my U.S. Pat. No. 4,671,417, can be quickly and easily inserted into slots 33 and display items hung therefrom for ready removal. Of course, other suitable hooks or item hanging devices may be inserted into slots 33. In fact, slots 33 need not be elongated but may be round or square or any suitable configuration to receive a mating hook or hanging device therein.

The device is thus a single piece of construction that is both cost effective and easily assembled. Since it can be shipped in the form of a blank, it reduces shipping costs. It can be used in both hookable and non-hookable applications since items may be merely stacked in each compartment. It is adapted to be used with hardware of various types insertible in slots 33 and can be any suitable height, width and number of compartments.

I claim:

1. A display rack comprising:

a pair of spaced side walls, a rear wall interconnecting the side walls, a top wall closing off the upper end of said interconnected side walls and rear wall, and a bottom wall closing off the lower end of said interconnected side walls and rear wall;

a plurality of vertically spaced horizontally extending ledges mounted between said side walls;

a vertical partition wall extending vertically upwardly from each of said ledges thereby forming a pair of adjacent compartments; and display item hanging device aperture means in each of said compartments adapted to receive a display item hanging device therein.

2. In the rack of claim 1 wherein said rack is formed from a single sheet of planar material.

3. In the rack of claim 2 wherein said material cardboard.

4. A blank for forming a free standing display rack comprising:

a single sheet of planar material, said sheet having a main body portion (37), a first side row (38) connected to said main body portion (37) along a first fold line (39), a second side row (63) connected to said main body portion (37) along a second fold line (64), a first flap (47) connected to said first row (38) by a third fold line (44) extending normal to said first fold line (39), a first slot (46) extending along said third fold line (44) at generally the middle thereof, a second flap (82) connected to said second row (63) by a fourth fold line (84) extending normal to said second fold line (64), a second slot (86) extending along said fourth fold line (84) at generally the middle thereof, a third flap (90) connected to said main body portion (37) by a fifth fold line (92) adjacent said first flap (42) and spaced therefrom, a third slot (94) extending along said fifth fold line (92) at generally the middle thereof, a fourth flap (91) connected to said main body portion (37) by a sixth fold line (93) adjacent said second flap (82) and separated therefrom, a fourth slot (95) extending along said sixth fold line (93) at generally the middle thereof, a fifth flap (88) disposed between said third and fourth flaps (90, 91) and spaced therefrom and connected to said main body portion (37) along a seventh fold line (89) generally coincident with said third, fifth, sixth and fourth fold lines (44, 92, 93, 84), said fifth flap (85) having adjacent said third flap (90) and a second edge adjacent said fourth flap (91), and a slot (96, 97) extending along each of said edges at generally the middle thereof, a pair of spaced tabs (100, 101) extending from said fifth flap (88) and connected thereto along eighth and ninth fold lines, respectively (103, 104), said seventh and eighth fold lines (103, 104) extending generally parallel to said seventh fold line (89) but spaced therefrom, a sixth flap (40) extending along said first side row (38) and connected thereto along a tenth fold line (41), said outer edge of said sixth flap (40) having a plurality of spaced arcuate sections (50 through 55) therealong, the intersection of each of said sections (50 through 55) forming a plurality of spaced tabs (56 through 62), a seventh flap (66) extending along said second side row (63) and connected thereto along an eleventh fold line (67), said outer edge of said seventh flap (66) having a plurality of spaced arcuate sections (69 through 74) therealong, the intersection of each of said sections (69 through 74) forming a plurality of spaced tabs (75 through 81), an eighth flap (43) connected to said first side row (38) along a twelfth fold line (45) extending normal to said first fold line (39), a fifth slot (47) provided along said twelfth fold line (45) at the middle thereof, a ninth flap (83) connected to said seventh flap (66) along a thirteenth folding (85), a sixth slot provided along said thirteenth fold line (85) at the middle thereof, a tenth flap (111) spaced from said eighth flap (43) and connected to said main body portion (37) along a fourteenth fold line (113), a seventh slot (115) provided along said fourteenth fold line (113) at the middle thereof, an eleventh flap (112) spaced from said ninth flap (83) and connected to said main body portion (37) along a fifteenth fold line (114), an eighth slot (116) provided along said fifteenth fold line (114) at the middle thereof, a twelfth flap (105) disposed between said tenth and eleventh flaps (111, 112) and spaced therefrom, said twelfth flap (105) being connected to said main body portion (37) along a sixteenth fold line (106) coincident with said twelfth, fourteenth, fifteenth and thirteenth fold lines (45, 113, 114, 85), said twelfth flap (105) having an pair of spaced side edges adjacent each of said tenth and eleventh flaps (111, 112) with a slot (109', 110') along each of said spaced side edges of said twelfth flap (105) at the middle thereof, said twelfth flap (105) having an outer edge spaced from said sixteenth fold line and parallel thereto having a pair of spaced tabs (107, 108) thereon extending in a direction away from said last-mentioned edge, and connected thereto by fold lines (109, 110), said main body portion (37) having a plurality of cut-out sections (117 through 122) therethrough, each of said cut-out sections (117 through 122) having an upper elongated edge (89') extending parallel to said seventh fold line (89), a pair of spaced tabs (123) being connected to opposite ends of said upper elongated edge (89') along fold lines (125, 126), each of said cut-out sections (117 through 122) being further defined by curved side edges extending from opposite ends of said upper elongated edge (89') to a fold line (133) extending parallel to said upper elongated edge (89'), a rectangular panel (129) disposed in each of said cut-out sections (117 through 122) divided into a pair of juxtaposed generally rectangular sections (131, 132) separated by a slot (130) extending partway through said rectangular panel (129), said rectangular panel (129) being integral with said fold line (133) connected to said curved side edges, each of said rectangular sections (131, 132) having a tab (134, 135) thereon extending toward said upper elongated edge (89') and each of said rectangular sections (131, 132) also having a side flap (136, 137) connected to its respective rectangular section (131, 132) along a fold line (138, 139) with a slot disposed along each of said last-mentioned fold lines (138, 139) at the middle thereof.

5. In the blank of claim 4 wherein six said cut-out sections (117 through 122) are provided.

6. In the blank of claim 4 wherein a fold line (127, 128) extends between each of said cut-out sections (117 through 122) generally coincident with said fold lines (138, 139) of said side flaps (136, 137) connected to said rectangular sections (131, 132) and perpendicular to the fold lines (125, 126) of said spaced tabs (123) connected to said upper elongated edge (89').

7. In the blank of claim 6 wherein a fold line (127, 28) extends between said uppermost cut-out section (117 through 122) generally coincident with said fold lines (138, 139) of said side flaps (136, 137) connected to said rectangular sections (131, 132) and perpendicular to the fold lines (125, 126) of said spaced tabs (123) connected to said upper elongated edge (89') to said seventh fold line (89).

8. In the blank of claim 7 wherein a fold line (127, 128) extends between said lowermost cut-out sections (117 through 122) generally coincident with said fold lines (138, 139) of said side flaps (136, 137) connected to said rectangular sections (131, 132) and perpendicular to the fold lines (125, 126) of said spaced tabs (123) connected to said upper elongated edge (89') to said sixteenth fold line (106).

* * * * *